US009585465B2

(12) United States Patent
Vasquez

(10) Patent No.: US 9,585,465 B2
(45) Date of Patent: Mar. 7, 2017

(54) DEVICE FOR CLEANING AN OBJECT

(71) Applicant: Carlos Vasquez, San Diego, CA (US)

(72) Inventor: Carlos Vasquez, San Diego, CA (US)

( * ) Notice: Subject to any disclaimer, the term of this patent is extended or adjusted under 35 U.S.C. 154(b) by 0 days.

(21) Appl. No.: 14/733,826

(22) Filed: Jun. 8, 2015

(65) Prior Publication Data

US 2015/0351527 A1 Dec. 10, 2015

Related U.S. Application Data

(60) Provisional application No. 62/009,070, filed on Jun. 6, 2014.

(51) Int. Cl.

| | |
|---|---|
| ***A46B 17/06*** | (2006.01) |
| ***A46B 11/06*** | (2006.01) |
| ***A46B 11/00*** | (2006.01) |

(52) U.S. Cl.

CPC ..... *A46B 17/06* (2013.01); *A46B 11/00* (2013.01); *A46B 11/063* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,834,510 | A * | 12/1931 | Yeater | A47L 13/22 15/147.1 |
| 4,074,944 | A * | 2/1978 | Xavier | A46B 11/0055 401/182 |
| 5,398,365 | A | 3/1995 | MacKenzie | |
| 5,406,967 | A | 4/1995 | Eberle | |
| 6,213,667 | B1 | 4/2001 | Isaac | |
| 7,464,431 | B2 | 12/2008 | Stevens | |
| 8,342,768 | B1 * | 1/2013 | Johnston | B05B 1/18 401/282 |
| 2004/0047675 | A1 * | 3/2004 | Bonelli | A46B 11/063 401/289 |
| 2008/0089734 | A1 | 4/2008 | Ruiz | |
| 2008/0095571 | A1 | 4/2008 | Geigle | |

* cited by examiner

*Primary Examiner* — David Walczak
(74) *Attorney, Agent, or Firm* — Loza & Loza, LLP; Heidi L. Eisenhut

(57) ABSTRACT

A cleaning devices for cleaning objects such as paint brushes. The cleaning device includes a head portion positioned along a longitudinal axis and a handle portion connected to the head portion and positioned along the longitudinal axis. The head portion may include an upper surface; a flat lower surface opposite the upper surface; a pair of side surfaces joining the upper and lower surfaces. The handle portion may include a front handle portion; and a back handle portion, the front handle portion connected to the back head portion. The flat lower surface of the head portion includes a plurality of holes for propelling liquid in a forward direction. The flat lower surface of the head portion further includes a plurality of groups of bristles extending perpendicular outward.

13 Claims, 2 Drawing Sheets

DEVICE FOR CLEANING AN OBJECT

CLAIM OF PRIORITY UNDER 35 U.S.C. §119

The present Application for Patent claims priority to U.S. Provisional Application No. 62/009,070 entitled "DEVICE FOR CLEANING A BRUSH", filed Jun. 6, 2014, assigned to the assignee hereof and hereby expressly incorporated by reference herein

FIELD

Various features relate to devices for cleaning objects, such as paint brushes or paint rollers.

BACKGROUND

Brushes, such as paint brushes, are typically used for surface finishing. The bristles of the brush absorb paint (or any other liquid, liquefiable, or mastic composition that, after application to a surface in a thin layer, converts to a solid film) and transfer it to the surface. To maintain the quality and durability of the paint brush, when painting is completed for the day, the bristles of the paint brush must cleaned or else the paint will dry on the bristles rendering it useless for further painting. As brushes used by professional painters can be expensive, it is cost-effective to clean the bristles of each brush after it has been used.

Paint brushes are typically cleaned by placing the bristles of the paint brush on the edge of the paint can and wiping or scraping the paint off the bristles into the paint can. This process may be done multiple times for each side of the brush to ensure as much paint is removed from the bristles as possible. The remaining paint is then washed off with water and the bristles are allowed to air dry.

Other methods of cleaning paint brushes involve spraying water from a hose, such as a garden hose, at the bristles. This method is haphazard, messy, and fails to clean every part of the bristles or other paint-carrying surface. Additionally, this method is wasteful of water as only some of the water comes into contact with the paint brush and a big percentage of the water shoots away from the paint brush, making the roller spin, splashing watered paint in every direction causing a messy and environmentally hazardous situation.

In view of the foregoing, what is needed is a device for cleaning the soiled objects, such as the bristles of brushes, which uses less water, prevents dirtied liquid from the cleaning, such as watered paint, from splashing in every direction, and is time efficient for an individual to use.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one aspect, a cleaning device is provided. The cleaning device includes a head portion positioned along a longitudinal axis and a handle portion connected to the head portion and positioned along the longitudinal axis. The head portion may include an upper surface; a flat lower surface opposite the upper surface; and a pair of side surfaces joining the upper and lower surfaces. The handle portion may include a front handle portion; and a back handle portion, the front handle portion connected to the back head portion. The flat lower surface of the head portion includes a plurality of holes for propelling liquid in a forward direction. The flat lower surface of the head portion further includes a plurality of groups of bristles extending perpendicular outward.

According to one feature, each of the side surfaces in the pair of side surfaces comprise an upper side portion having a upper side top end and an upper side bottom end; and a lower side portion having a lower side top end and a lower side bottom end, the lower side top end integrally connected to the upper side bottom end.

According to another feature, the upper side portion of the each side surface extends downwardly from the upper surface to the lower side top end of the each side surface in a convex configuration.

According to yet another feature, the lower side portion of the each side surface extends downwardly from the upper side bottom end to the lower side bottom end in a convex configuration.

According to yet another feature, a vertical distance of the upper side portion is the same as a vertical distance of the lower side portion.

According to yet another feature, a horizontal width between the upper side bottom ends of the side surfaces in the pair of side surfaces is less than a horizontal width between the lower side bottom ends of the side surfaces in the pair of side surfaces.

According to yet another feature, the lower side bottom ends of the side surfaces in the pair of side surfaces is detachably connected to the flat lower surface.

According to yet another feature, the cleaning device includes one or more spikes integrally connected to and extending perpendicularly downward from the flat lower surface. The one or more spikes are located on an outer edge of the flat lower surface.

According to yet another feature, the cleaning device includes a scrapping edge located on the outermost edge of the flat lower surface.

According to yet another feature, the handle member includes a hand grip portion; and a trigger portion pivotally attached or coupled to the hand grip portion, the trigger portion adapted for movement between a no flow position and an open position. When the trigger portion is in the open position, fluid flows to the housing and propels out the plurality of holes.

According to yet another feature, the cleaning device further includes a flow control knob connected to the hand grip portion for adjusting the amount and force of fluid that is propelled out of the plurality of holes.

According to another aspect, a cleaning device is provided. The cleaning device includes a head portion positioned along a longitudinal axis and a handle portion connected to the head portion and positioned along the longitudinal axis. The head portion may include an upper surface; a flat lower surface opposite the upper surface; and a pair of side surfaces joining the upper and lower surfaces. Each side surface of the pair of side surfaces comprises an upper side portion having a upper side top end and an upper side bottom end; and a lower side portion having a lower side top end and a lower side bottom end, the lower side top end integrally connected to the upper side bottom end. One or more spikes may be detachably connected to and extend downwardly from an outer edge of the flat lower surface.

The handle portion may include a front handle portion; and a back handle portion, the front handle portion connected to the back head portion. The flat lower surface of the head portion includes a plurality of holes for propelling liquid in a forward direction and a plurality of groups of bristles extending perpendicular outward.

DETAILED DESCRIPTION

The following detailed description is of the best currently contemplated modes of carrying out the invention. The description is not to be taken in a limiting sense, but is made merely for the purpose of illustrating the general principles of the invention. Furthermore, in the following description, specific details are given to provide a thorough understanding of the embodiments. However, it will be understood by one of ordinary skill in the art that the embodiments may be practiced without these specific details.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

While the present invention is described primarily with respect to the cleaning of paint brushes, the present invention may be applied and adapted to cleaning of other objects such as paint rollers.

In the following description, certain terminology is used to describe certain features of one or more embodiments of the invention. The term "object" may refer any material thing that can be seen and touched, including, but not limited to brushes, rollers, grilles, gardening tools, toys, bicycles, automobiles, motorcycles, bricks, stones and concrete. The term "soiled" may refer to making an object dirty: befoul, begrime, besmirch, besoil, black, blacken, defile, dirty, smudge, smutch and sully. The term "paint" may refer to any liquid, liquefiable, or mastic composition that, after application to a surface in a thin layer, converts to a solid film. The term "fluid" refers to water or any other type of liquid cleaning solution that may be used for cleaning a soiled object. The term "debris" may refer to anything having a material existence which soils an object, including but not limited to, dirt, paint, grease, grime, dust and lint.

Figure 1:
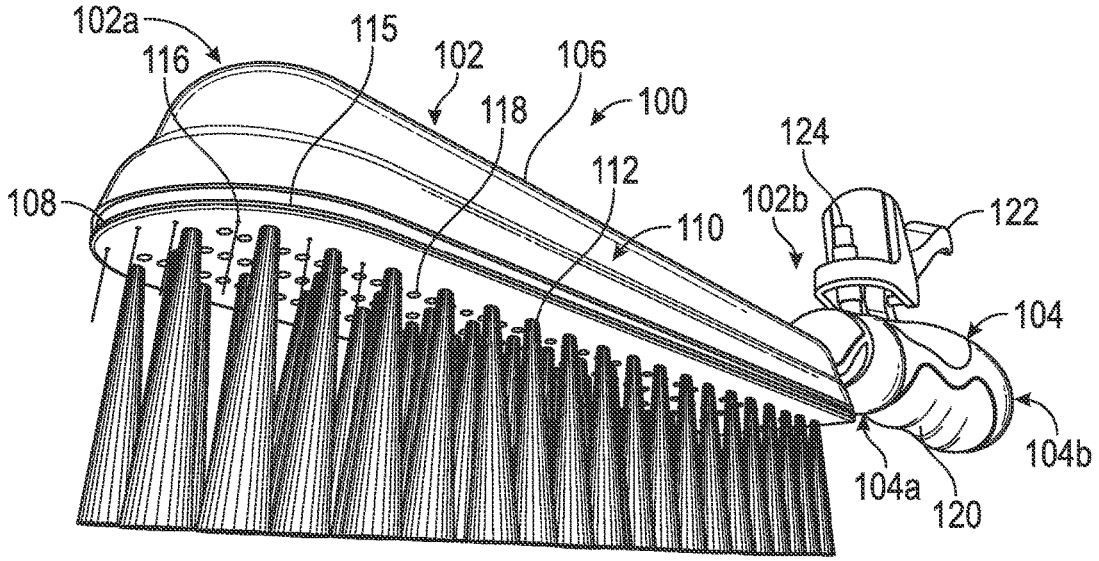
FIG. 1 is an illustration of a left perspective view of a cleaning device, according to one embodiment.
Figure 2:
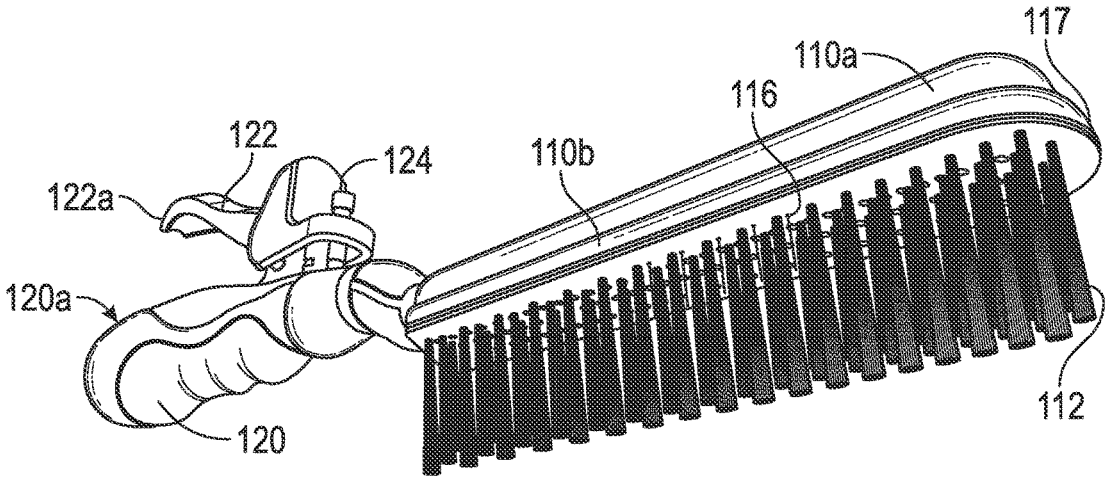
FIG. 2 is an illustration of a right perspective view of the cleaning device, according to one embodiment.
Figure 3:
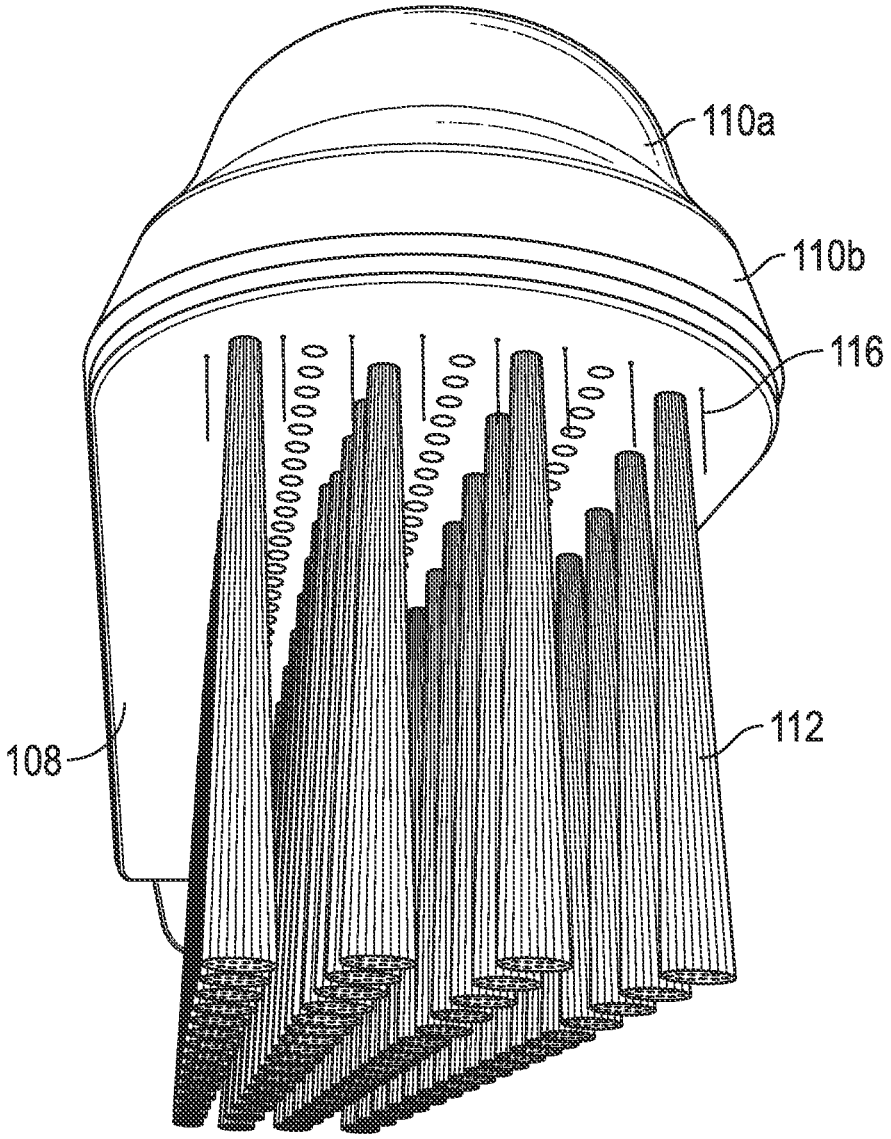
FIG. 3 is an illustration of a front perspective view of a cleaning device, according to one embodiment.

FIG. 1 is an illustration of a left perspective view of a cleaning device 100, according to one embodiment. FIG. 2 is an illustration of a right perspective view of the cleaning device 100, according to one embodiment. FIG. 3 is an illustration of a front perspective view of the cleaning device 100, according to one embodiment. The following discussion refers interchangeably to FIGS. 1-3.

As shown, the cleaning device 100 may include a head portion 102 and a handle portion 104. According to one embodiment, the head portion 102 may be integrally attached to the handle portion 104. According to another embodiment, the head portion 102 may be detachably coupled to the handle portion 104. According to another embodiment, the head portion 102 may be rotatably connected to the handle portion 104 allowing the user to rotate the handle portion 104 relative to the head portion 102. The handle portion 104 may be rotated clockwise or counterclockwise from anywhere between 0-90 degrees for providing a user various configuration in which to use the cleaning device 100. For example, the handle portion 104 may be rotated 45 degrees either in the clockwise or counterclockwise direction.

The head portion 102 may be positioned along a longitudinal axis and include a front head portion 102*a* and a back head portion 102*b*. The handle portion 104 may be positioned along the longitudinal axis and include a front handle portion 104*a* and a back handle portion 104*b*, the front handle portion 104*a* connected to the back head portion 102*b*.

According to one embodiment, the head portion 102 may include an opening in the front head portion 102*a* and the back head portion 102*b*. Opening in both ends of the head portion 102 allowing the handle portion 104 to be detachably connected to the front head portion 102*a* or the back head portion 102*b* as desired by the user. In one configuration, a plug may be used to fill the opening not filled with the handle portion 104.

The head portion 102 may be defined by an upper surface 106 having a generally rounded configuration, a lower surface 108 opposite the upper surface 106 and side surfaces 110 joining the upper and lower surfaces 106, 108. According to one embodiment, the upper surface 106 may have a curved, rounded or convex configuration while the lower surface 108 may have a generally flat surface. Each of the side surfaces 110 may include an upper side portion 110*a* and a lower side portion 110*b*. Each of the upper and lower side portions 110*a*, 110*b* may comprise a top end and a bottom end. The top ends of the upper side portions 110*a* may extend downwardly from the upper surface 106 to the top ends of the lower side portions 110*b* in a generally convex or rounded configuration. The lower side portions 110*b* may extend outwardly downward from the upper side portions 110*a* to the lower surface 108 in a generally convex or rounded configuration.

The vertical distance of the upper side portions 110*a* may be approximately the same as the vertical distance of the lower side portions 110*b*. Alternatively, the upper side portions 110*a* may have a vertical distance that is longer than or shorter than the vertical distance of the lower side portions 110*b*. According to one embodiment, the horizontal width between the bottom ends of the upper side portions 110*a* may be smaller than the horizontal width between the bottom ends of the lower side portions 110*b*. The smaller horizontal width between the upper side portions 110*a* may allow for a user to easily grasp the upper side portions 110*a*.

According to one embodiment, the bottom ends of the upper side portions 110*a* may be integrally connected to the top ends of the lower side portions 110*b*. According to one embodiment, the bottom ends of the lower side portions 110*b* may be integrally connected to the lower surface 108. According to another embodiment, the bottom ends of the lower side portions 110*b* may be detachably connected to the lower surface 106 allowing for lower surfaces 108 of various configurations to be secured.

The lower surface 108 may include a plurality of groups of bristles 112 extending outward in a generally perpendicular direction and a plurality of holes 118 for propelling water, or other liquid, in a forward direction. According to one embodiment, the plurality of holes 118 may be dispersed between the groups of bristles 112. Although three rows of holes 118 are shown extending along the longitudinal length of the lower surface 108, this is by way of example only. In alternative embodiments, the plurality of holes 118 may be formed through the lower surface 108 in any configuration, for example holes 118 may only be located at the top end of the flat lower surface 108 of the head portion 102 or may only be located at the bottom end of the flat lower surface 108 of the head portion 102 closest to the handle portion 104. In an additional embodiment, only the center portion of the lower surface 108 may include holes 118 or the holes 118 may only be located at the top and bottom ends of the lower surface 108 and no holes in the center portion of the lower surface 108.

According to one embodiment, one or more nails or small spikes 116 may be located on an outer edge of the flat lower surface 108. In one configuration, the spikes 116 may extend around the entire perimeter of the lower surface 108 or may just be located on one or more sections of the outer perimeter such as around the front end of the lower surface 108 (See FIG. 1) or extending along one or both sides of the flat lower surface 108 (See FIG. 2). The spikes 116 may be integrally connected to the flat lower surface 108 or may be detachably coupled to the flat lower surface 108. Furthermore, the spike may have a length less than the length of the bristles or the spikes may be the same length of the bristles. For example, the spikes 116 may be a quarter the length of the bristles or the spikes may be half the length of the bristles or the spikes may be three quarters the length of the spikes.

In one example the plurality of groups of bristles 112 may be used to scrape or scrub the paint or debris from a paint brush or other object. Water or other liquid may propel out the plurality of holes 118 while a user is scraping or scrubbing the object, before a user begins scraping or scrubbing and/or after the user has scraped or scrubbed the object. The spikes 116 may be used in conjunction with, or separately from, the plurality of groups of bristles 112 for scraping or scrubbing debris or other dirt from the object.

According to one embodiment, the outermost edge 115 of the lower surface 108 of the cleaning device 100, or the bottom edge 117 of the lower side portion 110*b*, may form a scraping or grinding edge to scrape or grind debris or other unwanted material from an object being cleaned. In alternative embodiments, one or more scrapping attachments may be fixedly or removably secured to the outer edge of the lower surface 108.

According to one embodiment, the back handle portion 104*b* may include internal threads (not shown) for mating with external threads (not shown) of a hose (not shown). When the hose is turned on, water flows into the head portion 102 and propels out the plurality of holes 118 in the lower surface 108 of the head portion 102. In alternative embodiments, the internal threads of the back handle portion 104*b* may be threadingly engaged with any device which allows a liquid to flow through the cleaning device 100 and proper out the plurality of holes 118. In one configuration, the liquid may be water mixed with soap or other cleaning agent.

The handle portion 104 may be integrally or detachable connected to the head portion 102. The handle portion 104 may include a hand grip portion 120 and a trigger portion 122, the trigger portion 122 may be pivotally attached or coupled to the hand grip portion 120. The trigger portion 122 may be adapted for movement between a no flow position, wherein a bottom portion 122*a* of an inner surface of the trigger portion 122 is spaced apart from a bottom portion 120*a* of the hand grip portion 120, and an open position wherein the bottom portion 122*a* of the inner surface of the trigger portion 122 is in contact with the bottom portion 120*a* of the hand grip portion 120. When in the open position, fluid flows to the head portion 102 and propels out the plurality of holes 118. A flow control knob 124 may be located on the trigger portion 122 (or alternatively on the handle grip portion 120) for adjusting the amount and force of fluid that is propelled out of the plurality of holes 118.

As described above, the back handle portion 104*b* may include internal threads (not shown) for mating with external threads (not shown) on a hose (not shown). When the hose is turned on and the trigger portion 122 is in the open position, water or other liquid may flow into the head portion 102 and propel out the plurality of holes 118 in the lower surface 108. In one example the water may be propelled onto bristles of a paint brush or onto a paint roller and the water propelling out the plurality of holes 118 washes the paint or other debris off the object, such as a paint brush or a paint roller. As the water is propelled out the plurality of holes 118, it is propelled into the paint brush or paint roller soaking paint out of the bristles or roller. The brush or roller being cleaned may be placed in a bucket so that the paint and contaminated water are collected within the bucket and not splashed on the ground. As described previously, the user may utilize the plurality of groups of bristles 112 extending from the lower surface 108 while the water is propelled onto the object being cleaned. That is, the user may simultaneously scrub the paint off the object while the water is propelling outward from the plurality of holes 118.

One or more of the components and functions illustrated in FIGS. 1-3 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A cleaning device, comprising:

a head portion positioned along a longitudinal axis, the head portion comprising:
- an upper surface;
- a flat lower surface opposite the upper surface; and
- a pair of side surfaces joining the upper and lower surfaces, wherein each side surface comprises:
  - an upper side portion having an upper side top end and an upper side bottom end; and
  - a lower side portion having a lower side top end and a lower side bottom end, the lower side top end integrally connected to the upper side bottom end; and a handle portion connected to the head portion and positioned along the longitudinal axis, the handle portion comprising:
- a front handle portion; and
- a back handle portion, the front handle portion connected to the back handle portion;

wherein the flat lower surface of the head portion includes a plurality of holes for propelling liquid in a forward direction;

wherein the flat lower surface of the head portion further includes a plurality of groups of bristles extending perpendicular outward; and wherein a horizontal width between the upper side bottom ends of the side surfaces in the pair of side surfaces is less than a horizontal width between the lower side bottom ends of the side surfaces in the pair of side surfaces;

wherein the upper side portion of the each side surface extends downwardly from the upper surface to the lower side top end of the each side surface in a convex configuration; and wherein the lower side portion of the each side surface extends downwardly from the upper side bottom end to the lower side bottom end in a convex configuration.

2. The device of claim 1, wherein the lower side portion of the each side surface extends downwardly from the upper side bottom end to the lower side bottom end in a convex configuration.

3. The device of claim 2, wherein a vertical distance of the upper side portion is the same as a vertical distance of the lower side portion.

4. The device of claim 2, wherein the lower side bottom ends of the side surfaces in the pair of side surfaces is detachably connected to the flat lower surface.

5. The device of claim 1, further comprising one or more spikes integrally connected to and extending perpendicularly downward from the flat lower surface.

6. The device of claim 5, wherein the one or more spikes are located on an outer edge of the flat lower surface.

7. The device of claim 1, further comprising a scraping edge located on the outermost edge of the flat lower surface.

8. The device of claim 1, wherein the handle member comprises:

a hand grip portion; and a trigger portion pivotally coupled to the hand grip portion, the trigger portion adapted for movement between a no flow position and an open flow position.

9. The device of claim 8, wherein when the trigger portion is in the open position and adapted for fluid to flow to the housing and propels out the plurality of holes.

10. The device of claim 8, further comprising a flow control knob connected to the hand grip portion for adjusting the amount and force of fluid that is propelled out of the plurality of holes.

11. A cleaning device, comprising:

a head portion positioned along a longitudinal axis, the head portion comprising:

an upper surface;

a flat lower surface opposite the upper surface; and a pair of side surfaces joining the upper and lower surfaces, each side surface of the pair of side surfaces comprising:

an upper side portion having a upper side top end and an upper side bottom end; and a lower side portion having a lower side top end and a lower side bottom end, the lower side top end integrally connected to the upper side bottom end;

one or more spikes connected to and extending perpendicularly downward from the flat lower surface; and a handle portion connected to the head portion and positioned along the longitudinal axis, the handle portion comprising:

a front handle portion; and a back handle portion, the front handle portion connected to the back handle portion;

wherein the flat lower surface of the head portion includes a plurality of holes for propelling liquid in a forward direction;

wherein the flat lower surface of the head portion further includes a plurality of groups of bristles extending perpendicular outward; and wherein a horizontal width between the upper side bottom ends of the side surfaces in the pair of side surfaces is less than a horizontal width between the lower side bottom ends of the side surfaces in the pair of side surfaces;

wherein the upper side portion of the each side surface extends downwardly from the upper surface to the lower side top end of the each side surface in a convex configuration; and wherein the lower side portion of the each side surface extends downwardly from the upper side bottom end to the lower side bottom end in a convex configuration.

12. The device of claim 11, wherein a vertical distance of the upper side portion is the same as a vertical distance of the lower side portion.

13. A cleaning device, comprising:

a head portion positioned along a longitudinal axis, the head portion comprising:

an upper surface;

a flat lower surface opposite the upper surface; and a pair of side surfaces joining the upper and lower surfaces, each side surface of the pair of side surfaces comprising:

an upper side portion having a upper side top end and an upper side bottom end; and a lower side portion having a lower side top end and a lower side bottom end, the lower side top end integrally connected to the upper side bottom end; and one or more spikes connected to and extending perpendicularly downward from the flat lower surface; and a handle portion connected to the head portion and positioned along the longitudinal axis, the handle portion comprising:

a front handle portion; and a back handle portion, the front handle portion connected to the back handle portion;

wherein the flat lower surface of the head portion includes a plurality of holes for propelling liquid in a forward direction; and wherein the flat lower surface of the head portion further includes a plurality of groups of bristles extending perpendicular outward;

wherein the upper side portion of the each side surface extends downwardly from the upper surface to the lower side top end of the each side surface in a convex configuration;

wherein the lower side portion of the each side surface extends downwardly from the upper side bottom end to the lower side bottom end in a convex configuration;

wherein a vertical distance of the upper side portion is the same as a vertical distance of the lower side portion; and wherein a horizontal width between the upper side bottom ends of the side surfaces in the pair of side surfaces is less than a horizontal width between the lower side bottom ends of the side surfaces in the pair of side surfaces.

* * * * *